US010767550B2

(12) United States Patent
Ferrari et al.

(10) Patent No.: US 10,767,550 B2
(45) Date of Patent: Sep. 8, 2020

(54) TWO-STROKE INTERNAL COMBUSTION ENGINE

(71) Applicant: EMAK S.P.A., Bagnolo in Piano (RE) (IT)

(72) Inventors: Marco Ferrari, Carpi (IT); Vincenzo Gagliardi, Modena (IT)

(73) Assignee: EMAK S.P.A., Bagnolo in Piano (RE) (IT)

( * ) Notice: Subject to any disclaimer, the term of this patent is extended or adjusted under 35 U.S.C. 154(b) by 0 days.

(21) Appl. No.: 16/324,345

(22) PCT Filed: Jul. 25, 2017

(86) PCT No.: PCT/IB2017/054509
§ 371 (c)(1),
(2) Date: Feb. 8, 2019

(87) PCT Pub. No.: WO2018/047024
PCT Pub. Date: Mar. 15, 2018

(65) Prior Publication Data

US 2019/0170054 A1 Jun. 6, 2019

(30) Foreign Application Priority Data

Sep. 8, 2016 (IT) ..... 102016000090851

(51) Int. Cl.
*F02B 25/14* (2006.01)
*F02F 1/22* (2006.01)
(Continued)

(52) U.S. Cl.
CPC ..... *F02B 25/14* (2013.01); *F02B 33/04* (2013.01); *F02B 33/28* (2013.01); *F02B 63/02* (2013.01);
(Continued)

(58) Field of Classification Search
CPC ..... F02B 25/14; F02B 63/02; F02B 33/28; F02B 33/04; F02B 2075/025; F02F 1/002; F02F 1/22
See application file for complete search history.

(56) References Cited

U.S. PATENT DOCUMENTS 5,251,580 A 10/1993 Torigai
2005/0133189 A1* 6/2005 Yamada ..... B22D 19/0009 164/113

FOREIGN PATENT DOCUMENTS

EP 2463495 A2 6/2012
JP S58155114 A 9/1983

* cited by examiner

*Primary Examiner* — Jacob M Amick
*Assistant Examiner* — Charles Brauch
(74) *Attorney, Agent, or Firm* — Volpe and Koenig, P.C.

(57) ABSTRACT

Herein described is a two-stroke internal combustion engine (100), comprising: a cylinder (135) having a pre-set central axis (B); a piston (145) slidably coupled to the cylinder (135) and suitable to divide the interior volume thereof into two distinct chambers, including a combustion chamber (150) and a pumping chamber (155); an intake duct (160) communicating with the pumping chamber (155); an exhaust duct (170) communicating with the combustion chamber (150); and at least one scavenging duct (180) suitable to place the pumping chamber (155) in communication with the combustion chamber (150); wherein said scavenging duct (180) comprises a terminal portion (190) leading to the combustion chamber (150) which extends with configuration diverging from an inlet section (200) up to an outlet section (205) obtained on a lateral surface of the cylinder (135).

9 Claims, 6 Drawing Sheets

(51) Int. Cl.

| | |
|---|---|
| ***F02B 33/04*** | (2006.01) |
| ***F02B 33/28*** | (2006.01) |
| ***F02F 1/00*** | (2006.01) |
| ***F02B 63/02*** | (2006.01) |
| ***F02B 75/02*** | (2006.01) |

(52) U.S. Cl.
CPC ..... *F02F 1/002* (2013.01); *F02F 1/22* (2013.01); *F02B 2075/025* (2013.01)

TWO-STROKE INTERNAL COMBUSTION ENGINE

TECHNICAL FIELD

The present invention regards two-stroke internal combustion engines, in particular two-stroke engines intended to actuate small work equipment such as for example chainsaws, string trimmers and the like.

PRIOR ART

As known, two-stroke engines may comprise at least one cylinder within which there is slidably received a piston that divides the interior volume of the cylinder into two distinct chambers; a combustion chamber and a pumping chamber.

An air and fuel mixture, whose combustion produces exhaust gases in rapid expansion causing the movement of the piston before flowing out through an exhaust duct, is periodically introduced into the combustion chamber.

The comburent air is generally supplied through an intake duct, which places the pumping chamber in communication with the external environment.

The amount of air introduced into the pumping chamber can be regulated by means of a power valve, typically a butterfly valve, which is arranged in the intake duct and it can be activated from the external so as to vary the opening degree thereof.

The fuel is normally supplied by means of a carburettor, which comprises a venturi pipe arranged along the intake duct, typically upstream of the power valve, and a dispensing nozzle which terminates into the venturi pipe and which is in communication with a fuel tank.

Thus, the airflow which flows along the venturi pipe generates a depression which, through the dispensing nozzle, intakes the fuel from the tank and it with the air directed towards the pumping chamber.

The air and fuel mixture which gathers in the pumping chamber is subsequently pushed into the combustion chamber thanks to the movement of the piston, which forces it to flow through a series of scavenging ducts which place the pumping chamber in communication with the combustion chamber.

These scavenging ducts are generally open at the end of the expansion stroke of the piston, when the exhaust duct is open, so that the air and fuel mixture facilitates the cleaning of the cylinder, i.e. it pushes the combustion gases to flow out of the exhaust duct.

Each scavenging duct generally comprises an initial portion exiting from the pumping chamber, extending parallel to the cylinder, and a terminal portion terminating in the combustion chamber, extending transversely towards the cylinder.

Generally, the cross-section of the terminal portion is substantially constant or slightly convergent towards the cylinder, so as to accelerate and direct the air and fuel mixture towards the interior of the combustion chamber.

However, it was observed that small amounts of the air and fuel mixture can be directly suctioned into the exhaust duct flowing from the engine unburnt.

DESCRIPTION OF THE INVENTION

An object of the present invention is to overcome or at least reduce this drawback of the prior art through a solution that is simple, rational and inexpensive.

These and other objects are attained by the characteristics of the invention, which are outlined in the independent claim 1. The dependent claims outline preferred and/or particularly advantageous aspects of the invention.

In particular, an embodiment of the present invention provides a two-stroke internal combustion engine comprising:

- a cylinder having a pre-set central axis,
- a piston slidably coupled to the cylinder and suitable to divide the interior volume of the cylinder into two distinct chambers; a combustion chamber and a pumping chamber,
- an intake duct communicating with the crank case,
- an exhaust duct communicating with the combustion chamber, and
- at least one scavenging duct suitable to place the pumping chamber in communication with the combustion chamber, wherein said scavenging duct comprises a terminal portion terminating in the combustion chamber (150) which extends with configuration diverging from an inlet section up to an outlet section (205) obtained on a lateral surface of the cylinder.

In other words, the terminal portion of the scavenging duct widens progressively moving from the inlet section towards the outlet section.

Thanks to this solution, it was observed that the flow of the air and fuel mixture fuel flowing into the combustion chamber, though maintaining an optimal directionality, tends to separate from the lateral surface of the scavenging duct and reach very high speeds.

This enables improving the cleaning of the cylinder and simultaneously reducing the amount of air and fuel mixture flowing from the exhaust duct unburnt.

According to an aspect of the invention, the inlet section of the terminal portion may define a choke in the scavenging duct.

In other words, the inlet section may be narrower not only as regards all the passage sections of the terminal portion, but also all the passage sections of at least the scavenging duct that is immediately upstream with respect thereto (with respect to the direction of flow of the mixture).

Thus, the flow of the air and fuel mixture that flows along the scavenging duct is accelerated at the initial section of the terminal portion i.e. the choke, and then projected into the combustion chamber at a higher speed.

According to another aspect of the invention, the inlet section of the terminal portion may be the narrowest passage section of the entire scavenging duct.

In other words, the area of the inlet section of the terminal portion may be smaller than the area of all the other passage sections of the scavenging duct.

Thus, the acceleration of the air and fuel mixture can be advantageously obtained without excessively increasing pressure drop.

According to a different aspect of the invention, the projection of the terminal portion of the scavenging duct on a median plane containing the axis of the cylinder may be fully contained in the projection of the outlet section on the same median plane.

Thanks to this solution, the terminal portion of the scavenging duct has no undercut surface with respect to the aforementioned median plane, thus enabling obtaining the engine by means of a casting process, in a relatively simple and inexpensive manner.

In particular, this solution enables obtaining the engine by means of a die-casting process, which advantageously allows reducing costs, thickness and tolerances with respect to the normal casting processes, for example sand casting.

Even more in particular, the aforementioned solution enables obtaining the interior wall of the terminal portion of the scavenging duct by means of a core (or insert) which can be advantageously extracted, at the end of the casting process, through just one straight motion in the perpendicular direction with respect to the median plane.

According to an aspect of the invention, the aforementioned median plane may be a symmetry plane of the exhaust duct and/or a symmetry plane of the intake duct.

These aspects enable rationalising the engine design, thus simplifying the die-casting process.

According to a different aspect of the invention, the outlet section of the terminal portion of the scavenging duct may be substantially rectangular-shaped.

This embodiment enables a more accurate opening/closure of the scavenging duct by the piston sleeve, during the various engine duty cycles.

According to a further aspect of the invention, a cross-section of the terminal portion of the scavenging duct, carried out according to a section plane orthogonal to the central axis of the cylinder, may be substantially trapezoidal-shaped.

This embodiment enables a better distribution of the air and fuel mixture in the combustion chamber.

In particular, the aforementioned cross-section may have a side substantially orthogonal to the median plane This solution facilitates the manufacturing of the engine by means of the die-casting process and it also enables nearing the terminal portion of the scavenging duct to the exhaust opening.

According to an aspect of the invention, the engine may comprise at least one pair of said scavenging ducts (which are shaped and arranged in a mutually symmetrical manner with respect to said median plane.

This solution enables making the cleaning of the cylinder as well as the loading of the air and fuel mixture into the combustion chamber more uniform and efficient.

BRIEF DESCRIPTION OF THE FIGURES

Further characteristics and advantages of the invention will be apparent from reading the following description—provided by way of non-limiting example—with reference to the figures illustrated in the attached drawings.

DETAILED DESCRIPTION

The aforementioned figures reveal an internal combustion engine 100, in particular a two-stroke internal combustion engine intended to actuate small work equipment such as for example chainsaws, string trimmers, blowers and the like.

The engine 100 comprises an outer body which can be made up of a casing 110 and a cylinder head 115 which is fixed to the casing 110, for example by means of screws.

Figure 1:
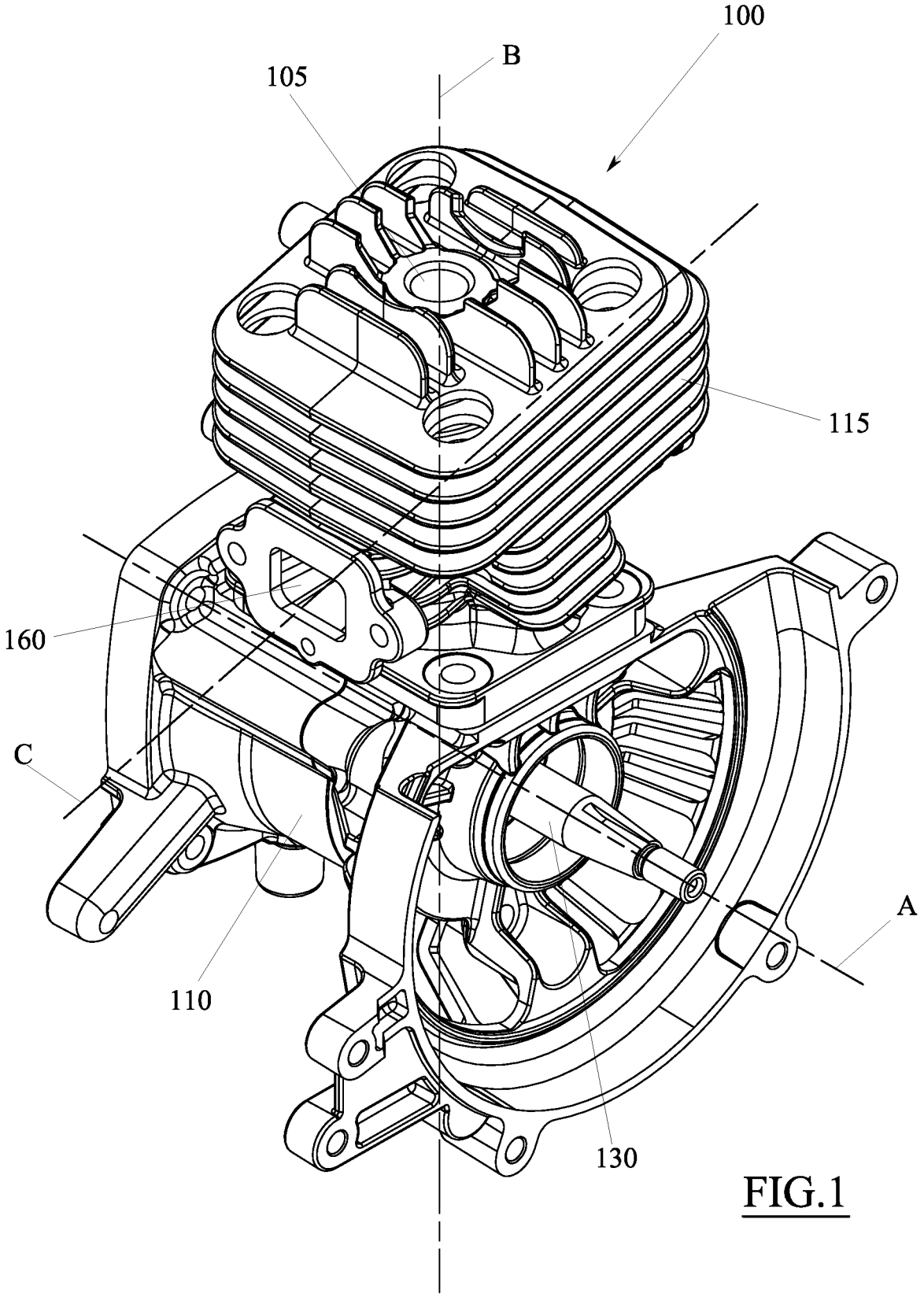
FIG. 1 is an axonometric view of a two-stroke internal combustion engine according to an embodiment of the present invention.
Figure 2:
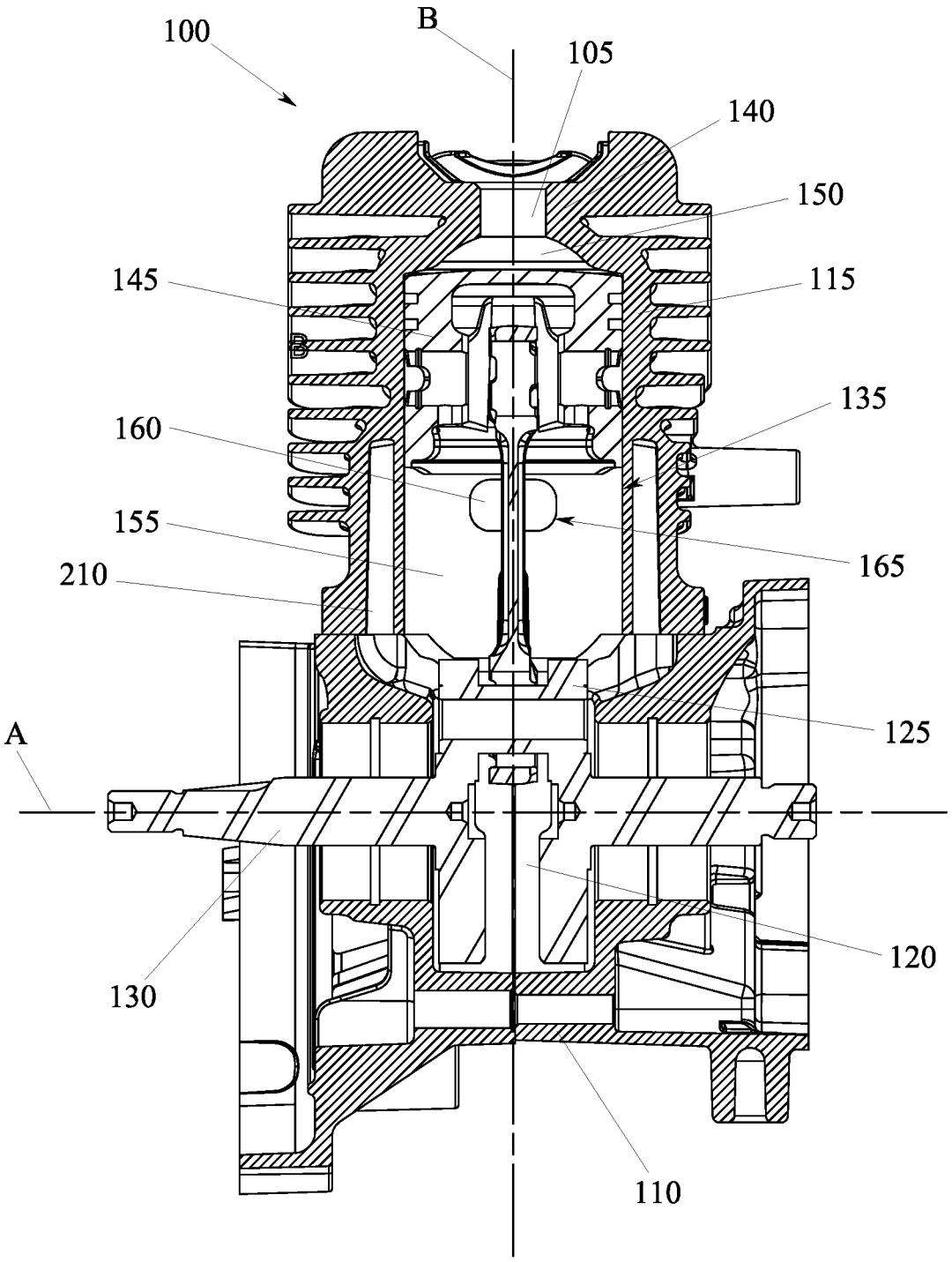
FIG. 2 is a section of the engine of FIG. 1 carried out according to a plane section containing the central axis of the cylinder and the rotational axis of the crank shaft.

As shown in FIG. 2, inside the casing 110 there is defined a crank chamber 120, in which there is received a crank 125 suitable to rotate around a pre-set rotational axis A.

The crank 125 may be made in a single piece with the rotating shaft 130, which is generally referred to as a crankshaft and whose axis coincides with the rotational axis A.

Inside the cylinder head 115 there is defined a cylinder 135, which terminates at one end in the crank chamber 120 while it is closed at the opposite end by a head wall 140.

The cylinder 135 extends longitudinally along a central axis B, which can be orthogonal and/or coplanar with the rotational axis A of the crank 125.

Inside the cylinder 135 there is slidably received a piston 145, which divides the interior volume into two separate chambers, including a combustion chamber 150 defined between the piston 145 and the head wall 140, and a pumping chamber 155 defined on the opposite side of the piston 145 and communicating with the crank chamber 120.

The separation between the combustion chamber 150 and the pumping chamber 155 may be improved by one or more sealing rings coaxially interposed between the sleeve of the piston 145 and the interior surface of the cylinder 135.

On the head wall 140 of the cylinder 135 there may be installed a spark plug (not illustrated), which may be inserted into a reception hole 105 and it is capable of igniting a spark in the combustion chamber 150.

In the cylinder head 115 there may be provided an intake duct 160, which is suitable to supply an air and fuel mixture into the pumping chamber 155.

Figure 3:
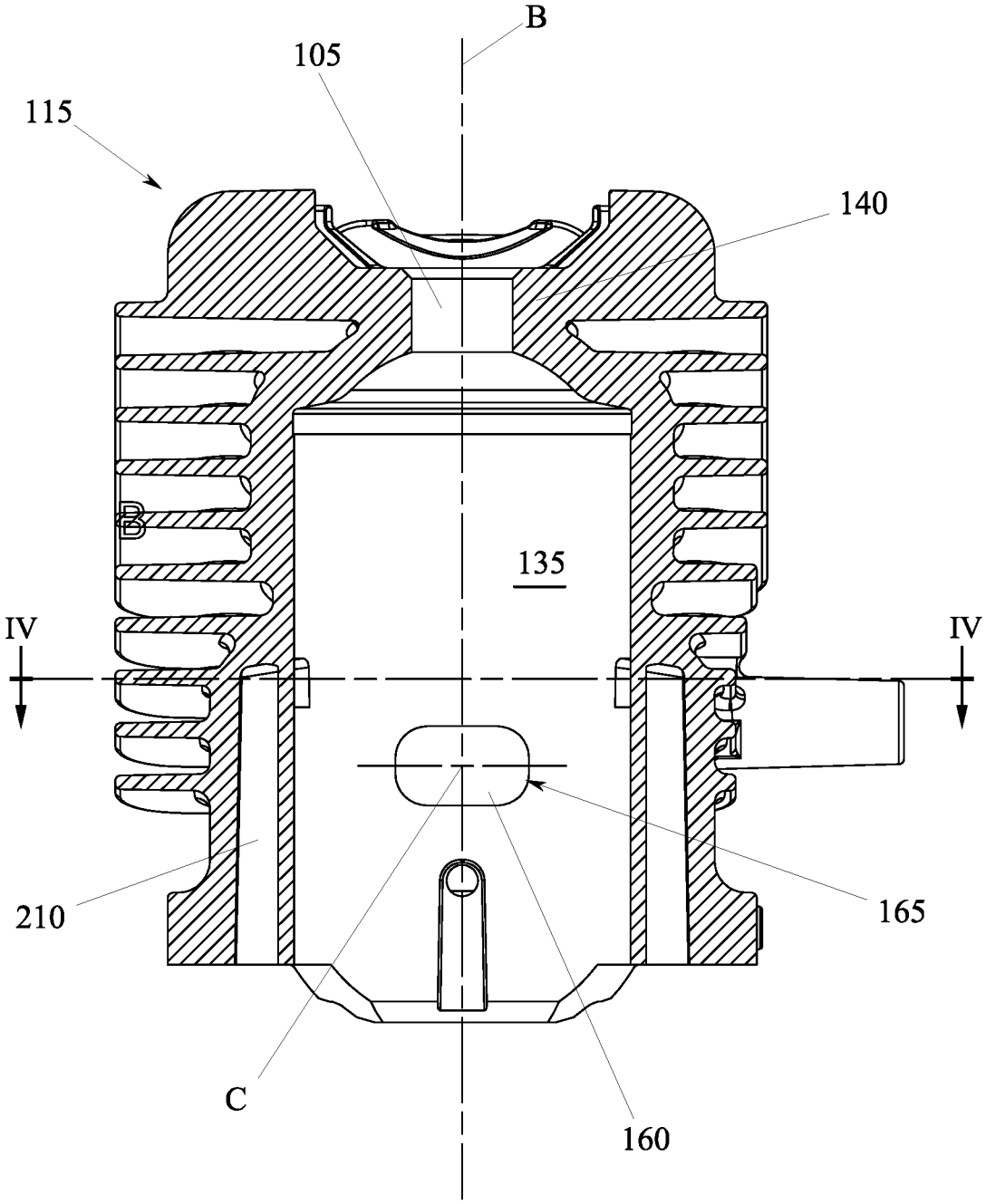
FIG. 3 is the section of FIG. 2 solely regarding the cylinder head, showed in enlarged scale.

As illustrated in FIG. 3, this intake duct 160 may extend longitudinally according to a central axis C which can be coplanar and/or orthogonal to the central axis B of the cylinder 135.

In particular, the intake duct 160 may extend with an almost constant passage section up to an outlet section 165, which may be substantially rectangular-shaped and can be obtained on interior surface of the cylinder 135.

The air and fuel mixture may be supplied through a conventional carburettor system (not illustrated), which can be connected to the intake duct 160. The carburettor may have the characteristics explained and described in the introduction.

Figure 4:
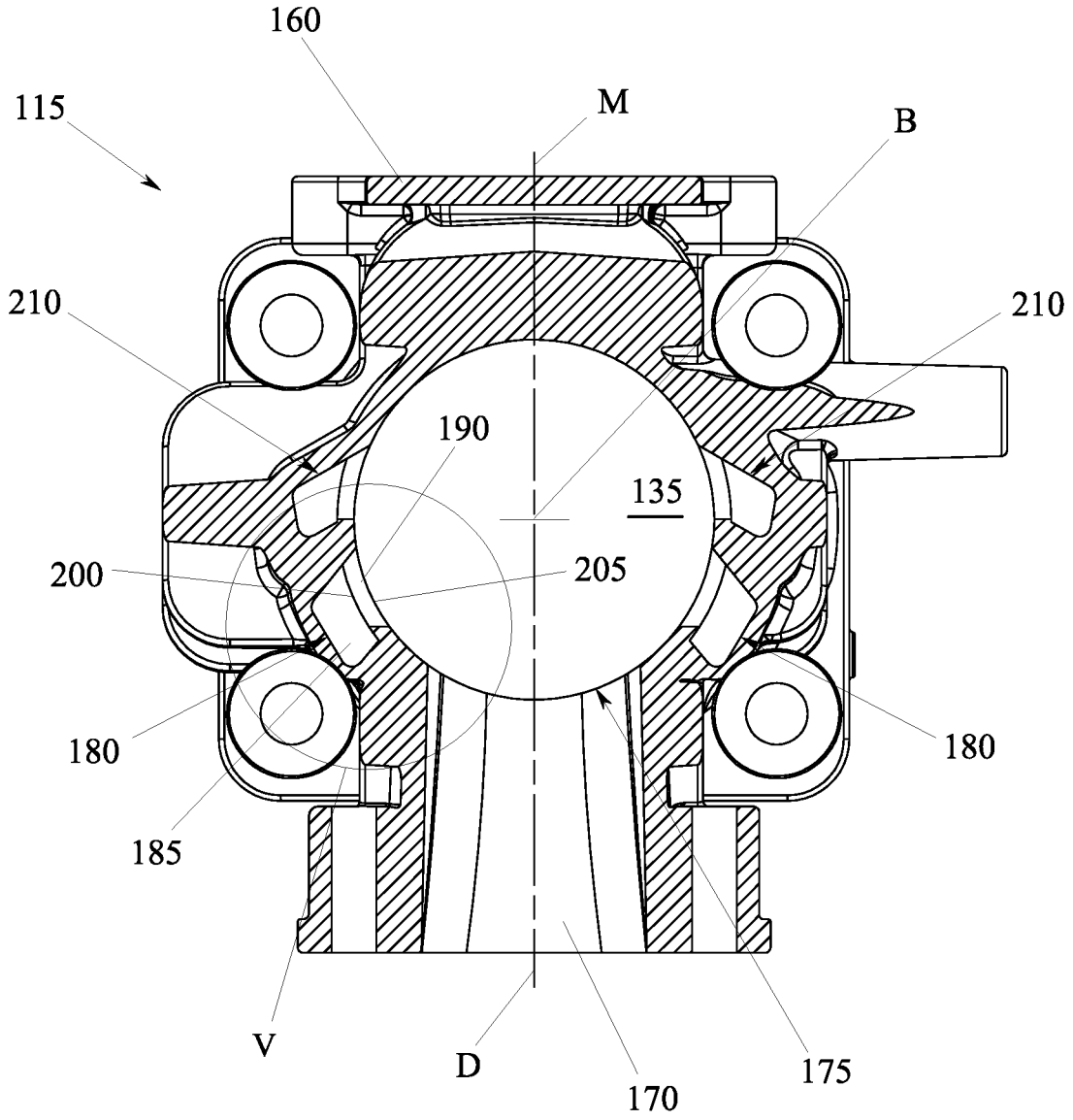
FIG. 4 is section IV-IV of FIG. 3.

As illustrated in FIG. 4, on the cylinder head 115 there may also be obtained an exhaust duct 170, which is suitable to convey the combustion gases produced in the combustion chamber 150 to the external.

This exhaust duct 170 extends longitudinally according to a central axis D which can be coplanar and/or orthogonal to the central axis B of the cylinder 135.

In particular, the exhaust duct 170 may extend with an almost constant passage section starting from an inlet section 175, which may be substantially rectangular-shaped and can be obtained on interior surface of the cylinder 135.

The inlet section 175 of the exhaust duct 170 is generally at least partly positioned at a greater height, i.e. closer to the head wall 140 of the cylinder 135, with respect to the outlet section 165 of the intake duct 160.

In addition, in the cylinder head 115 there is also obtained a first pair of scavenging ducts 180, which can be configured and arranged in a perfectly symmetrical manner with respect to a median plane M containing the central axis B of the cylinder 135 and, in the embodiment illustrated in the attached figures, also containing the central axes C and D respectively of the intake duct 160 and the exhaust duct 170.

Basically, the median plane M may be a symmetry plane not only of the cylinder 135, but also of the intake duct 160 and/or of the exhaust duct 170.

Figure 6:
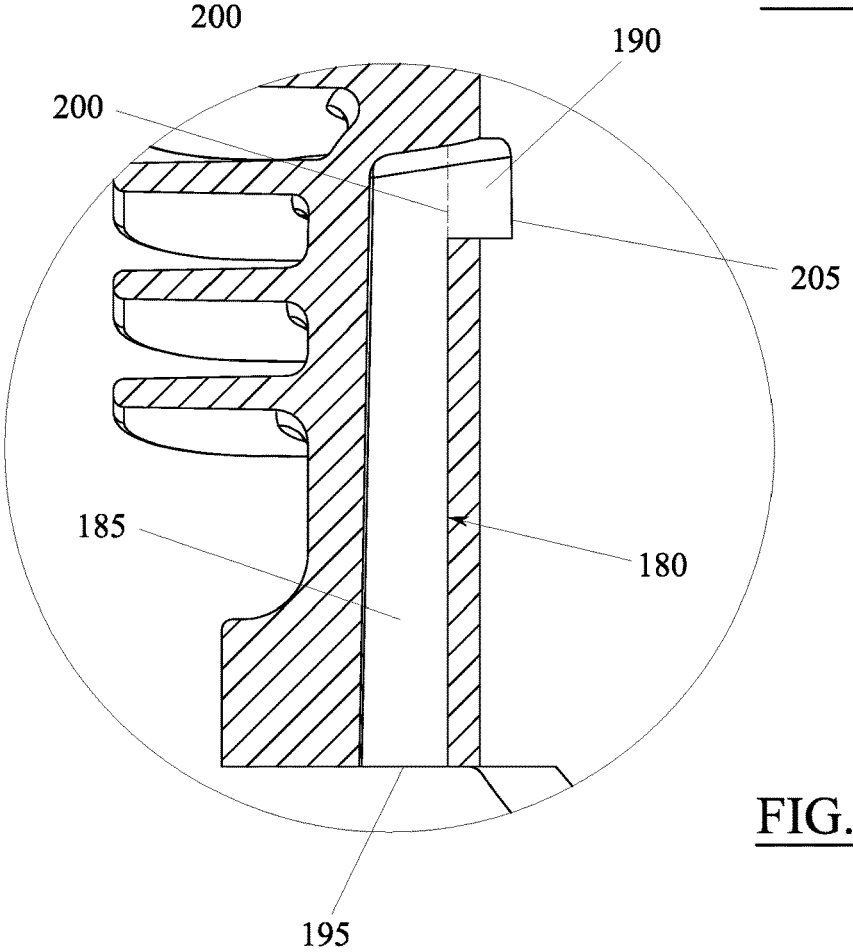
FIG. 6 is section VI-VI of FIG. 5.
Figure 7:
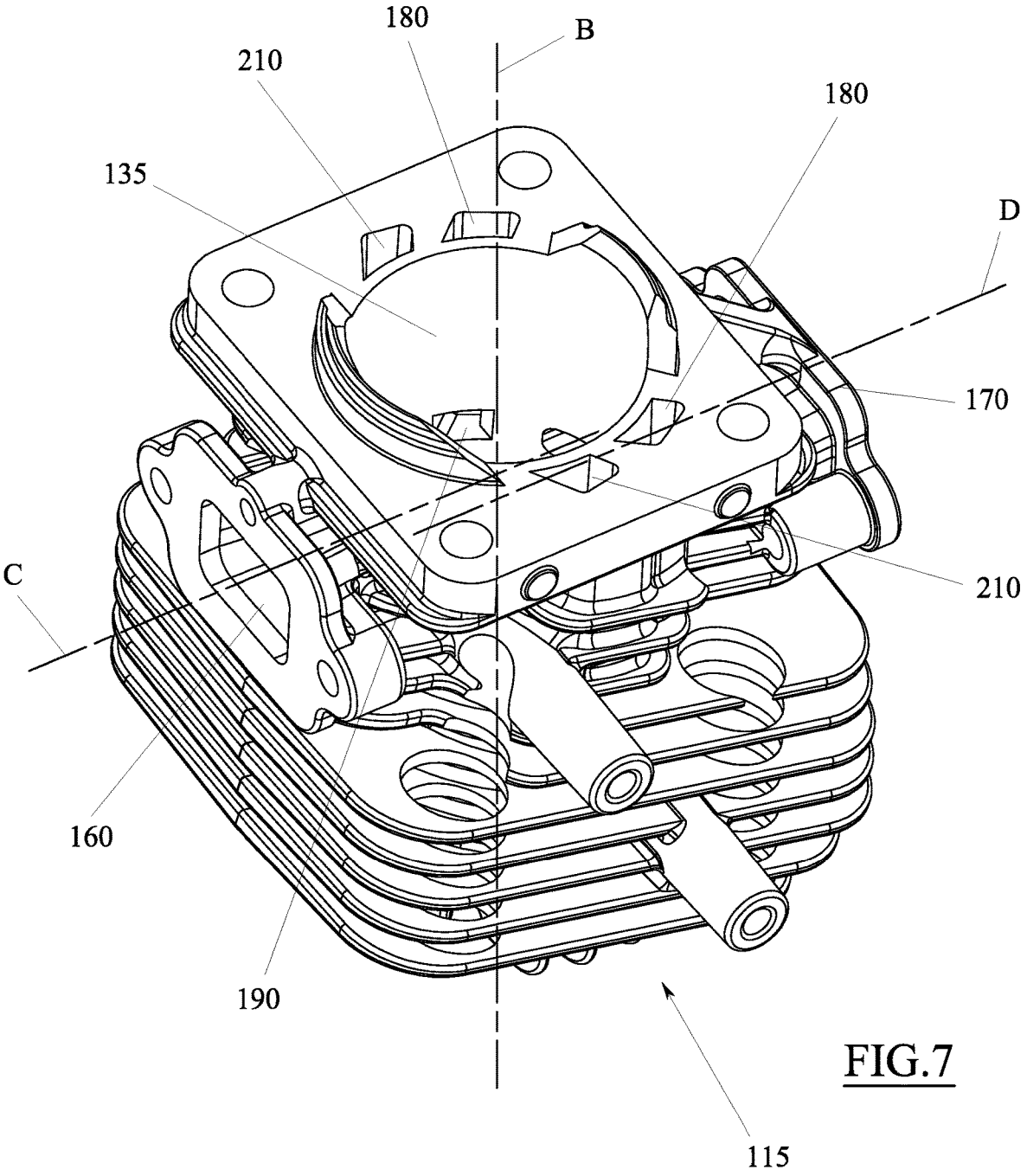
FIG. 7 is an axonometric view of the cylinder head of FIG. 3 shown capsized.

As illustrated in FIG. 6, each of these scavenging ducts 180 comprises a first section 185 exiting from the pumping chamber 155, generally through the crank chamber 120 (also see FIG. 2), which may extend in the direction substantially parallel to the central axis B of the cylinder 135, and a second portion 190 terminating in the combustion chamber 150, which may extend in the direction substantially transverse with respect to the central axis B.

In particular, the first portion 185 may be configured as a blind cavity which extends starting from an inlet section 195 towards an opposite closed end.

The inlet section may be obtained on a surface of the cylinder head 115 that is orthogonal to the central axis B of the cylinder 135 and which is suitable to remain exposed in the crank chamber 120 when the cylinder head 115 is joined to the casing 110.

The first portion 185 may have a converging configuration in which the area of the passage section, made with respect to a plane orthogonal to the central axis B of the cylinder 135, decreases progressively starting from the inlet section 195 towards the closed end.

The second portion 190 laterally derives from the first portion 185, for example at the closed end of the latter, and extends up to the inner surface of the cylinder 135.

As illustrated in FIG. 4, the second portion 190 has an inlet section 200 which is defined at the intersection between the second portion 190 and the first portion 185, and an opposite outlet section 205 which is directly obtained on the interior surface of the cylinder 135.

The second portion 190 may have a diverging configuration in which the area of the passage section increases progressively starting from the inlet section 200 towards the outlet section 205.

In particular, the projection of the second portion 190, i.e. of the inlet section 200 thereof, on the median plane M is fully contained in the projection of the outlet section 205 on the same median plane M.

Thus, the second section 190 of the scavenging duct 180 does not have any undercut surface with respect to the median plane M, enabling obtaining the cylinder head 115 through a casting process, for example a die-casting process.

In particular, this solution enables obtaining the interior wall of the terminal portion of the scavenging duct by means of a core (or insert) which can be advantageously extracted, at the end of the casting process, through just one straight motion in the perpendicular direction with respect to the median plane M.

More in detail, the outlet section 205 of the second portion 190 may be substantially rectangular-shaped and it can be positioned at a higher height, i.e. closer to the head wall 140 of the cylinder 135, with respect to the outlet section 165 of the intake duct 160, for example at a height comprised between the outlet section 165 of the intake duct and the inlet section 175 of the exhaust duct 170.

The inlet section 200 of the second portion 190 may be dimensioned according to the bore or displacement capacity of the engine 100 and it can be the narrowest passage section of the entire scavenging duct 180.

In other words, the inlet section 200 may be smaller than the area of all the other passage sections of the scavenging duct 180, both in the first portion 185 and in the second portion 190.

Thus, the inlet section 200 creates some sort of choke of the scavenging duct 180 hence enabling accelerating the mass of air and fuel that traverses it.

Figure 5:
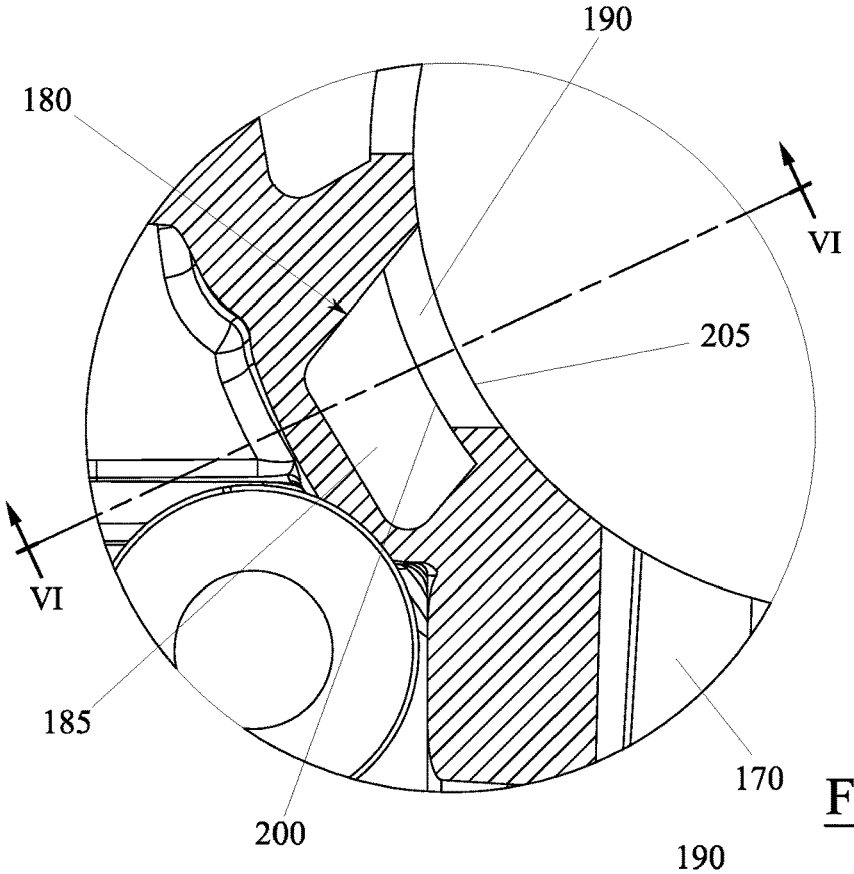
FIG. 5 is the detail V of FIG. 4 shown in enlarged scale.

As illustrated in FIG. 5, a cross-section of the second portion 190 of the scavenging duct 180, carried out according to a section plane orthogonal to the central axis B of the cylinder 135, may substantially be perimeter shaped to form trapezium, whose greater base coincides with the profile of the outlet section 205 while the smaller base coincides with the profile of the inlet section 200.

The side of the trapezium proximal to the exhaust duct 170 may be orthogonal to the median plane M or it may be inclined with respect to the orthogonal so as to be non-undercut with respect to the median plane M, for example about 1°.

This solution enables maintaining the outlet section 205 of the scavenging duct 180 very close to the inlet section 175 of the exhaust duct 170, without interference.

The side of the trapezium distal from the exhaust duct 170 may instead have a greater inclination than the proximal side, but still in the non-undercut direction with respect to the median plane M.

The cross-section of the first portion 185, carried out according to the same section plane, may be generally rectangular-shaped having a greater side from which the second portion 190 derives.

The width of this greater side of the first portion 185 is greater than the width of the inlet section 200 of the second portion 190, so that between them there is defined a triangular notch projecting on the opposite side with respect to the exhaust duct 170.

The angle at the vertex of this notch, that is, the angle formed by the side of the notch facing the second portion 190 of the scavenging duct 180 and the side of the notch facing the first portion 185, may be an acute angle, for example comprised between 40° and 70°, preferably equal to 55°.

In addition, the side of the notch facing the first portion 185 of the scavenging duct 180 may have a substantially arched section profile with its center on the central axis B of cylinder 135, or may have a substantially rectilinear section profile but tangent to an imaginary circumference centered on the central axis B of cylinder 135.

Back to FIG. 4, in the cylinder head 115 of the engine 100 may also be obtained in a second pair of scavenging ducts 210, which are arranged distant from the exhaust duct 170 with respect to the scavenging ducts 180.

Even the scavenging ducts 210 may be configured and arranged in a perfectly symmetrical manner with respect to the median plane M.

Each of these further scavenging ducts 210 may have shapes and dimensions partly different from the scavenging ducts 180 but they reproduce all previously described technical characteristics thereof, which will not be repeated herein but will still be deemed valid also as concerns the second scavenging ducts 210.

When the engine 100 is running, the fresh air and fuel mixture coming from the intake duct 160 is intaken into the pumping chamber 155 due to the depression created by the piston 145 each time the latter performs an ascent stroke towards the head wall 140 which closes the cylinder 135 (see FIG. 2).

While the piston 145 performs this ascent stroke, the air and fuel mixture already present in the combustion chamber 150 is simultaneously compressed. When the piston 145 is in proximity of the top dead centre, i.e. the position where the volume of the combustion chamber 150 is minimum, the spark plug is controlled to generate a spark that ignites the combustion of the air and fuel mixture.

Upon generating the spark, the combustion of the air and fuel mixture produces exhaust gases in rapid expansion that push the piston 145 to perform a descent stroke moving away from the head wall 140 of the cylinder 135.

During this descent stroke, the piston 145 firstly opens the inlet section 175 of the exhaust duct 170 to enable the exhaust gases to flow out towards the external environment, then it opens the outlet section 205 of the scavenging ducts 180 and 210, and then it closes the outlet section 165 of the intake duct 160.

Thus, in the last part of the descent stroke, the piston 145 pumps the mixture previously intaken into the pumping chamber 155 into the scavenging ducts 180 and 210 and from there to the combustion chamber 150.

Thanks to the particular configuration of the second portion 190 of the scavenging ducts 180, this mixture flow is accelerated at the choke defined by the inlet section 200 and projected into the combustion chamber 150 at a high speed.

In particular, it was observed that the mixture flow maintains a compact front and strong directionality, separating from the diverging walls of the second portion 190 of the scavenging duct 180.

Thus, the mixture flow penetrates deeply into the combustion chamber 50, reducing the amount of fuel that could flow out directly from the exhaust duct 170 unburnt.

Upon reaching the bottom dead centre position, i.e. the position where the volume of the combustion chamber 150 is maximum, the piston 145 starts a new ascent stroke.

During this ascent stroke, the piston 145 firstly closes the outlet section 205 of the scavenging ducts 180 and 210 and the exhaust duct 170 and then progressively reduces the volume of the combustion chamber 150, compressing the air and fuel mixture contained therein, so that the cycle can restart anew.

Obviously, the engine 100, as described above, may be subjected—by a man skilled in the art—to numerous technical/application modifications, without departing from the scope of protection of the invention as claimed below.

The invention claimed is:

1. A two-stroke internal combustion engine (100), comprising:

a cylinder (135) having a pre-set central axis (B), a piston (145) slidably coupled to the cylinder (135) and adapted to divide the interior volume of the cylinder (135) into two distinct chambers; a combustion chamber (150) and a pumping chamber (155), an intake duct (160) communicating with the pumping chamber (155), an exhaust duct (170) communicating with the combustion chamber (150), and at least one scavenging duct (180) adapted to place the pumping chamber (155) in communication with the combustion chamber (150), wherein said scavenging duct (180) comprises a first portion (185) exiting from the pumping chamber (155), which extends in a direction parallel to the central axis (B) of the cylinder (135), and a terminal portion (190) leading to the combustion chamber (150), which extends transversally with respect to the central axis (B) with configuration diverging from an inlet section (200) defined at an intersection between the terminal portion (190) and the first portion (185) up to an outlet section (205) obtained on a lateral interior surface of the cylinder (135), and wherein the projection of the inlet section (200) of the terminal portion (190) of the scavenging duct (180) on a median plane (M) containing the axis (B) of the cylinder (135) is fully contained in the projection of the outlet section (205) on the same median plane (M), said median plane (M) being a symmetry plane of the exhaust duct (170), wherein the cross-section of the terminal portion (190) of the scavenging duct (180), carried out according to a section plane orthogonal to the central axis (B) of the cylinder (135), is substantially trapezoidal-shaped.

2. The engine (100) according to claim 1, wherein the inlet section (200) of the terminal portion (190) defines a choke in the scavenging duct (180).

3. The engine (100) according to claim 2, wherein the inlet section (200) of the terminal portion (190) is the narrowest passage section of the entire scavenging duct (180).

4. The engine (100) according to claim 1, wherein said median plane (M) is a symmetry plane of the intake duct (160).

5. The engine (100) according to claim 1, wherein the outlet section (205) of the terminal portion (190) of the scavenging duct (180) is substantially rectangular-shaped.

6. The engine (100) according to claim 1, further comprising at least one pair of said scavenging ducts (180), which are shaped and arranged in a mutually symmetrical manner with respect to said median plane (M).

7. The engine (100) according to claim 1, wherein said cross-section of the terminal portion (190) of the scavenging duct (180) has a side proximal to the exhaust duct (170), which is substantially orthogonal to the median plane (M).

8. The engine (100) according to claim 1, wherein the cross-section of the first portion (185), carried out according to the section pane, have a side from which the terminal portion (190) derives, this side being greater than the inlet section (200) of the terminal portion (190), thereby defining a triangular notch having a vertex projecting on the opposite side with respect to the exhaust duct (170).

9. The engine (100) according to claim 8, wherein the vertex of the notch has an angle comprised between 40° and 70°.

* * * * *